US009611760B2

(12) United States Patent
Marino et al.

(10) Patent No.: US 9,611,760 B2
(45) Date of Patent: Apr. 4, 2017

(54) CUTBACK AFT CLAMP RING

(71) Applicant: SOLAR TURBINES INCORPORATED, San Diego, CA (US)

(72) Inventors: Christopher Anthony Marino, San Diego, CA (US); Nathan James Bohney, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 359 days.

(21) Appl. No.: 14/305,766

(22) Filed: Jun. 16, 2014

(65) Prior Publication Data

US 2015/0361812 A1 Dec. 17, 2015

(51) Int. Cl.

| | |
|---|---|
| ***F01D 25/30*** | (2006.01) |
| ***F01D 11/00*** | (2006.01) |
| ***F01D 25/24*** | (2006.01) |

(52) U.S. Cl.

CPC ..... *F01D 25/30* (2013.01); *F01D 11/003* (2013.01); *F01D 25/243* (2013.01); *F01D 25/246* (2013.01); *F05D 2300/176* (2013.01)

(58) Field of Classification Search

CPC ..... F01D 11/003; F01D 11/005; F01D 25/24; F01D 25/243; F01D 25/265; F01D 25/30; F02C 7/28

See application file for complete search history.

(56) References Cited

U.S. PATENT DOCUMENTS

| | | | | |
|---|---|---|---|---|
| 3,939,651 | A | 2/1976 | Penny | |
| 4,503,680 | A | 3/1985 | Wood | |
| 5,149,248 | A | 9/1992 | Cramer | |
| 6,116,013 | A | 9/2000 | Moller | |
| 6,352,404 | B1 | 3/2002 | Czachor et al. | |
| 7,185,499 | B2 | 3/2007 | Chereau et al. | |
| 2007/0086854 | A1* | 4/2007 | Blanton | B29C 65/562 403/338 |
| 2007/0113550 | A1 | 5/2007 | Sausee et al. | |
| 2009/0079139 | A1* | 3/2009 | Schiavo | F01D 9/04 277/595 |
| 2009/0224484 | A1* | 9/2009 | Chochua | F01D 11/003 277/411 |
| 2010/0074731 | A1* | 3/2010 | Wiebe | F01D 11/005 415/173.4 |
| 2013/0069313 | A1* | 3/2013 | Sonokawa | F01D 11/003 277/300 |

(Continued)

FOREIGN PATENT DOCUMENTS

DE 927782 C1 5/1955

*Primary Examiner* — Dwayane J White
*Assistant Examiner* — Sang K Kim
(74) *Attorney, Agent, or Firm* — Procopio, Cory, Hargreaves & Savitch, LLP

(57) ABSTRACT

An aft clamp ring for a gas turbine engine is disclosed. The aft clamp ring includes a body, a forward sealing face, and an aft sealing face. The body includes an annular shape extending between an outer end and an inner end. The forward sealing face faces in a second axial direction. The aft sealing face is adjacent the outer end facing in a first axial direction and is at least partially radially aligned with the forward sealing face. The forward sealing face and the aft sealing face are each an annular surface with a surface area from 105.50 $cm^2$ to 165.19 $cm^2$.

18 Claims, 5 Drawing Sheets

(56) References Cited

U.S. PATENT DOCUMENTS

| | | | | |
|---|---|---|---|---|
| 2014/0334933 | A1* | 11/2014 | Berard | F01D 11/003 416/215 |
| 2015/0226124 | A1* | 8/2015 | Tsutsumi | F01D 25/246 415/193 |
| 2015/0377047 | A1* | 12/2015 | Prestel | F01D 9/042 415/202 |
| 2016/0010477 | A1* | 1/2016 | Maret | F16J 15/3404 277/408 |

* cited by examiner

CUTBACK AFT CLAMP RING

TECHNICAL FIELD

The present disclosure generally pertains to gas turbine engines, and is directed toward a gas turbine engine including an aft clamp ring.

BACKGROUND

Gas turbine engines include compressor, combustor, and turbine sections. Two or more components within a section or in adjacent sections may be clamped together, such as by bolting, to form a seal between the components. Over time reduced sealing pressure, such as by bolt load relaxation can occur.

U.S. Pat. No. 6,116,013 to M. Moller discloses a coupling apparatus for connecting a combustor to a transition in a gas turbine. The coupling apparatus comprises a transition cylinder attached to the discharge end of the combustor, a cylinder flange formed on the downstream end of the transition cylinder, a transition having an upstream end on which a transition flange is formed, and a plurality of nut and bolt combinations circumferentially spaced about the periphery of the flanges for maintaining the transition when the cylinder flange mates with the transition flange. The cylinder flange further comprises a spigot lip and the transition flange further comprises a recess for receiving the spigot lip so as to effect a tight spigot fit when the cylinder flange mates with the transition flange.

The present disclosure is directed toward overcoming one or more of the problems discovered by the inventors.

SUMMARY OF THE DISCLOSURE

An aft clamp ring for a gas turbine engine is disclosed. In one embodiment, the aft clamp ring includes a body, a forward sealing portion, and an aft sealing portion. The body includes an annular shape extending between an outer end and an inner end located radially inward from the outer end. The body also includes an aft surface facing in a first axial direction and a forward surface facing in a second axial direction opposite the first axial direction. The forward sealing portion extends in the second axial direction from the body. The forward sealing portion includes a forward sealing face facing in the second axial direction. The forward sealing face is a first annular surface with a first surface area from 105.50 $cm^2$ to 165.19 $cm^2$. The aft sealing portion includes an aft sealing face adjacent the outer end facing in the first axial direction and at least partially radially aligned with the forward sealing face. The aft sealing face is a second annular surface with a second surface area from 105.50 $cm^2$ to 165.19 $cm^2$.

DETAILED DESCRIPTION

The systems and methods disclosed herein include an aft clamp ring including a forward sealing face and an aft sealing face. In embodiments, the forward sealing face and the aft sealing face are each separated, such as by a cutback, from a forward surface and an aft surface of the aft clamp ring respectively, which may reduce or prevent a bolt load from distributing from the forward sealing face and the aft sealing face to the forward and aft surfaces. Locating the bolt load on the forward sealing face and the aft sealing face may provide enough pressure between the forward sealing face and an adjoining surface, and the aft sealing face and an adjoining surface to maintain a seal in both locations when sealing pressure is reduced from flange coining and bolt load relaxation.

Figure 1:
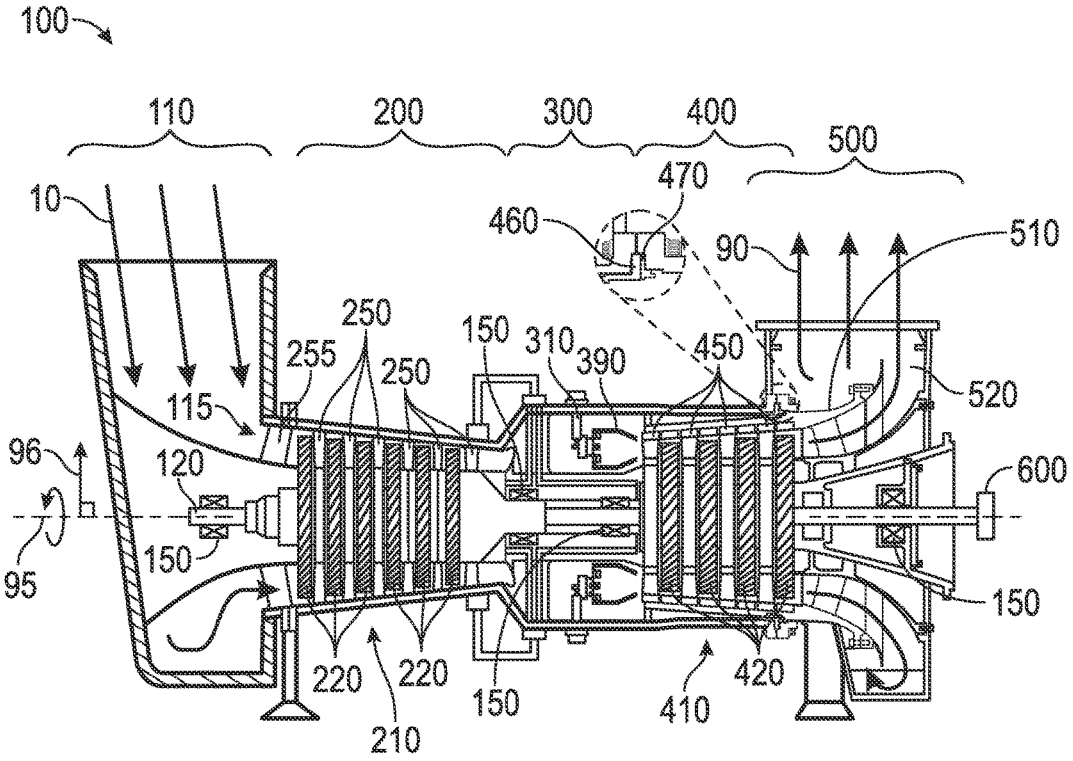
FIG. 1 is a schematic illustration of an exemplary gas turbine engine.

FIG. 1 is a schematic illustration of an exemplary gas turbine engine. Some of the surfaces have been left out or exaggerated (here and in other figures) for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from center axis 95, wherein a radial 96 may be in any direction perpendicular and radiating inward or outward from center axis 95.

A gas turbine engine 100 includes an inlet 110, a shaft 120, a gas producer or "compressor" 200, a combustor 300, a turbine 400, an exhaust 500, and a power output coupling 600. The gas turbine engine 100 may have a single shaft or a dual shaft configuration.

The compressor 200 includes a compressor rotor assembly 210, compressor stationary vanes ("stators") 250, and inlet guide vanes 255. The compressor rotor assembly 210 mechanically couples to shaft 120. As illustrated, the compressor rotor assembly 210 is an axial flow rotor assembly. The compressor rotor assembly 210 includes one or more compressor disk assemblies 220. Each compressor disk assembly 220 includes a compressor rotor disk that is circumferentially populated with compressor rotor blades. Stators 250 axially follow each of the compressor disk assemblies 220. Each compressor disk assembly 220 paired with the adjacent stators 250 that follow the compressor disk assembly 220 is considered a compressor stage. Compressor 200 includes multiple compressor stages. Inlet guide vanes 255 axially precede the first compressor stage.

The combustor 300 includes one or more injectors 310 and includes one or more combustion chambers 390.

The turbine 400 includes a turbine rotor assembly 410, and turbine nozzles 450 surrounded by a turbine housing 401. The turbine rotor assembly 410 mechanically couples to the shaft 120. As illustrated, the turbine rotor assembly 410 is an axial flow rotor assembly. The turbine rotor assembly 410 includes one or more turbine disk assemblies 420. Each turbine disk assembly 420 includes a turbine disk that is circumferentially populated with turbine blades. A turbine nozzle 450 axially precedes each of the turbine disk assemblies 420. Each turbine disk assembly 420 paired with the adjacent turbine nozzle 450 that precedes the turbine disk assembly 420 is considered a turbine stage. Turbine 400 includes multiple turbine stages. The turbine housing 401 may be a single piece or may be multiple pieces clamped together, such as by bolting.

The exhaust 500 includes an exhaust diffuser 510 and an exhaust collector 520.

The turbine 400 may include a power turbine flange assembly 499 configured to clamp, such as by bolting, the turbine housing 401 to the exhaust diffuser 510. The power turbine flange assembly 499 may include a nozzle case 460 and an aft clamp ring 470.

Figure 2:
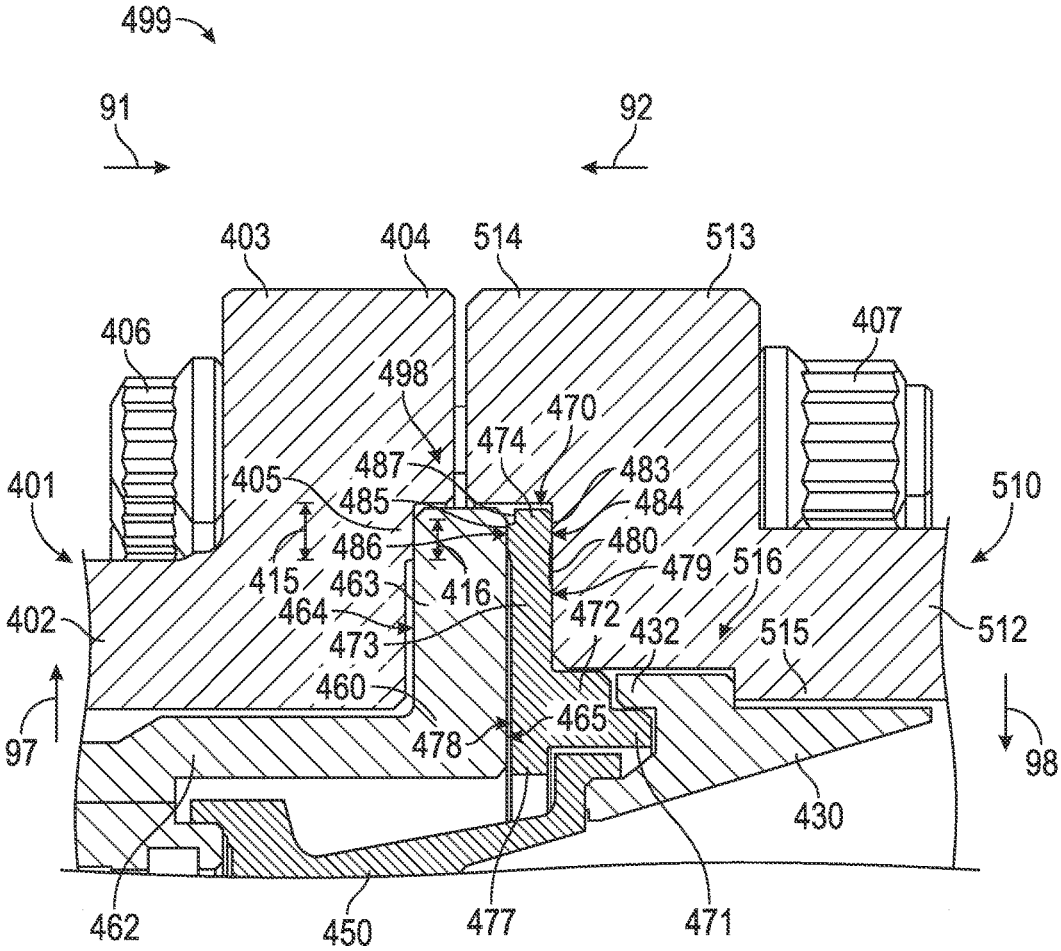
FIG. 2 is a section view of a portion of the turbine including the power turbine flange assembly of FIG. 1.

FIG. 2 is a section view of a portion of the turbine 400 including the power turbine flange assembly 499 of FIG. 1. Turbine housing 401 may include an aft portion 402, an aft flange 403, a secondary aft flange 404, and a case contacting portion 405. In some embodiments, turbine housing 401 is a single integral piece and aft portion 402 is the axial aft section of turbine housing 401. In other embodiments, turbine housing 401 includes multiple separate segments that are joined together, such as by bolting, and aft portion 402 is the axially aft segment.

Aft flange 403 is an annular ring extending radially outward from aft portion 402 proximate to exhaust diffuser 510, in a first radial direction 97. Aft flange 403 may extend from the aft end of aft portion 402. Secondary aft flange 404 is an annular ring extending axially aft from aft flange 403, in a first axial direction 91. The Secondary aft flange 404 may extend from the radially outer end of aft flange 403 and may be greater than half of the radial thickness of aft flange 403.

Case contacting portion 405 is an annular ring extending axially from at least aft flange 403, in the first axial direction 91. Case contacting portion 405 may also extend from a portion of aft portion 402. Case contacting portion 405 does not extend as far as secondary aft flange 404 in the first axial direction 91. Case contacting portion 405 is located radially inward from secondary aft flange 404 and may adjoin secondary aft flange 404. Case contacting portion 405 may include a case contacting portion height 415 which is a radial height of the case contacting portion 405. The case contacting portion height 415 may be configured to control the contact area between turbine housing 401 and nozzle case 460.

Exhaust diffuser 510 may include a diffuser body 512, a diffuser flange 513, a secondary diffuser flange 514, and a thickened portion 515. Diffuser body 512 may be a tapered wall, such as a bell mouth, forming the outer diffusing wall for the exhaust gas exiting the turbine 400. Diffuser body 512 may include a non-linear taper and may curve outward and transition generally from the first axial direction 91 to the first radial direction 97.

Diffuser flange 513 is an annular ring extending radially outward from diffuser body 512 proximate to aft portion 402, in the first radial direction 97. Diffuser flange 513 may extend from the forward end of diffuser body 512. Secondary diffuser flange 514 is an annular ring extending axially forward from diffuser flange 513 toward secondary aft flange 404, in a second axial direction 92, opposite the first axial direction 91. The Secondary diffuser flange 514 may extend from the radially outer end of diffuser flange 513 and may be greater than half of the radial thickness of diffuser flange 513.

Thickened portion 515 may extend radially inward from diffuser body 512 in a second radial direction 98, opposite the first radial direction 97. Thickened portion 515 may not extend from the end of diffuser body 512 forming a tip shoe gap 516. The tip shoe gap 516 may be an annular gap configured to receive a portion of the tip shoe 430.

Power turbine flange assembly 499 includes aft flange 403 and secondary aft flange 404 clamped to diffuser flange 513 and secondary diffuser flange 514. Power turbine flange assembly 499 includes fasteners, such as bolt 406, to clamp the assembly together. In the embodiment illustrated, a nut 407 is secured to bolt 406 to clamp the assembly together. The fasteners may extend through aft flange 403, secondary aft flange 404, secondary diffuser flange 514, and diffuser flange 513. Secondary aft flange 404 may contact secondary diffuser flange 514 within the power turbine flange assembly 499. The axial extensions of secondary aft flange 404 and secondary diffuser flange 514 may form an annular space 498 radially inward from secondary aft flange 404 and secondary diffuser flange 514, and axially between aft portion 402 and diffuser body 512.

Nozzle case 460 includes a case body 462 and a case flange 463. Case body 462 may be located generally radially inward from aft portion 402 and may be configured to support at least a portion of turbine nozzle 450. Case flange 463 may extend radially outward from the aft end of case body 462 in the first radial direction 97. Case flange 463 may extend into the annular space 498.

Case flange 463 may include a case forward surface 464 and a case aft surface 465. Case forward surface 464 may be an annular surface facing axially forward. Case forward surface 464 may be configured to contact case contacting portion 405. The annular contact area between case contacting portion 405 and case forward surface 464 may include a contact height 416. The contact height 416 may be from 6.325 mm (0.249 in.) to 7.899 mm (0.311 in.). The annular contact area may be from 202.12 $cm^2$ (31.328 $in.^2$) to 252.58 $cm^2$ (39.150 $in.^2$). Case aft surface 465 may be an annular surface facing axially aft and may be opposite case forward surface 464.

Aft clamp ring 470 may include a body 473, a first protrusion 472, and a second protrusion 471. Body 473 is an annular shape extending between and including an outer end 474 and an inner end 477. Inner end 477 may be located radially inward from and distal to outer end 474. Body 473 may include a forward surface 478 and an aft surface 479. Forward surface 478 may be an annular surface facing axially forward and may be adjacent nozzle case 460. In some embodiments, forward surface 478 may be spaced apart from case aft surface 465. Aft surface 479 may be an annular surface facing axially aft and may be adjacent diffuser body 512. In some embodiments, aft surface 479 may contact diffuser body 512.

First protrusion 472 may extend axially aft from body 473 proximate inner end 477 in the first axial direction 91. First protrusion 472 may be a hollow cylinder shape. Second protrusion 471 may extend axially aft from a radially inner portion of first protrusion 472 in the first axial direction 91. Second protrusion 471 may also be a hollow cylinder shape and may be radially narrower than first protrusion 472.

Aft clamp ring 470 may also include a forward sealing portion 485, a forward cutback 487, an aft sealing portion 483, and an aft cutback 480. Forward sealing portion 485 may extend axially forward from body 473 and may extend toward case body 462. Forward sealing portion 485 may be an annular protrusion. Forward sealing portion 485 may be at least partially radially aligned with case contacting portion 405 and may be proximate outer end 474. Forward sealing portion 485 may include a forward sealing face 486. Forward sealing face 486 is an annular surface and may be located both radially outward and axially forward of forward surface 478. Forward sealing face 486 is configured to contact and form a seal with case flange 463. Forward sealing face 486 may contact and form a seal with a radially outer portion of case aft surface 465.

Forward cutback 487 may be located radially outward from forward sealing portion 485. Forward cutback 487 may extend into body 473 and may extend from forward sealing portion 485 to outer end 474.

Aft sealing portion 483 may be located opposite forward sealing portion 485 and may be located adjacent outer end 474, such as by adjoining or neighboring outer end 474. Aft sealing portion 483 may be a part of body 473. Aft sealing portion 483 may be at least partially radially aligned with forward sealing portion 485 and may be at least partially radially aligned with case contacting portion 405. Aft sealing portion 483 may include an aft sealing face 484. Aft sealing face 484 may be an annular surface and may be located radially outward from aft surface 479 and may be axially aligned with aft surface 479, such as being coplanar to aft surface 479. Aft sealing face 484 may configured to contact and form a seal with exhaust diffuser 510.

Aft cutback 480 may be located between aft sealing face 484 and aft surface 479, being located radially inward from aft sealing face 484 and radially outward from aft surface 479. Aft cutback 480 may separate aft sealing face 484 from aft surface 479.

Aft clamp ring 470 may be configured to hold and may be configured to locate tip shoe 430 within gas turbine engine 100. Tip shoe 430 may include a hanger portion 432. Hanger portion 432 may be located radially outward and may be axially aligned with second protrusion 471 and may be at least partially held in place by second protrusion 471. Hanger portion 432 may also be located axially between first protrusion 472 and thickened portion 515. Thickened portion 515, first protrusion 472, and second protrusion 471 may be configured to hold tip shoe 430 in place. Turbine nozzle 450 may be supported at a forward end by nozzle case 460 and at an aft end by tip shoe 430.

Figure 3:
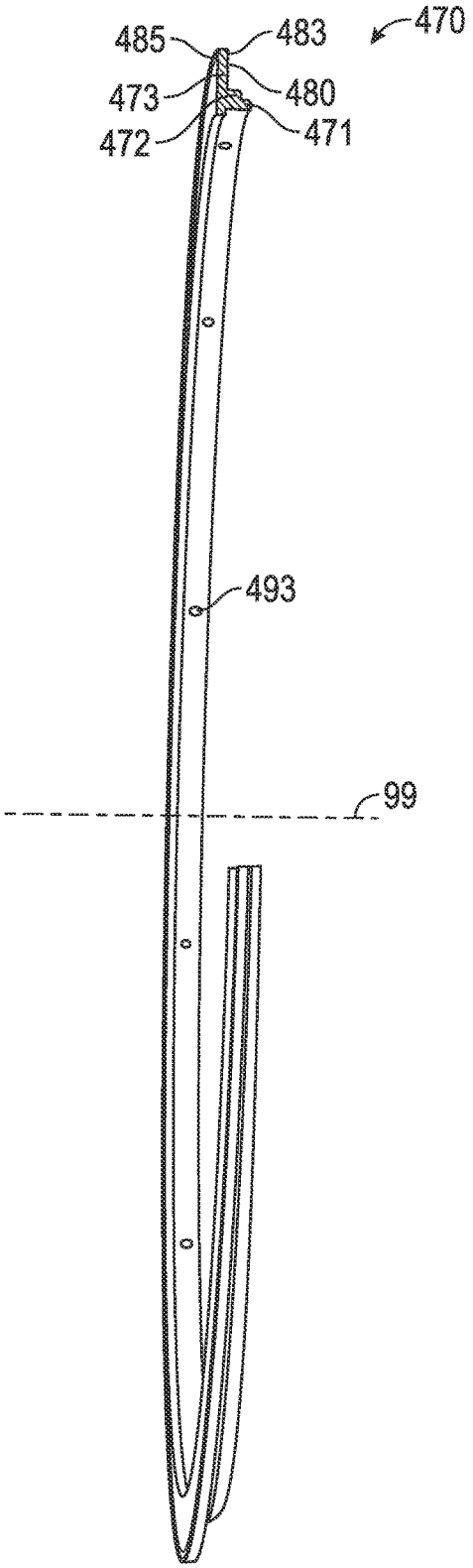
FIG. 3 is a perspective view of the aft clamp ring of FIG. 2 with a portion of the aft clamp ring cut away.

FIG. 3 is a perspective view of the aft clamp ring 470 of FIG. 2 with a portion of the aft clamp ring 470 cut away. Aft clamp ring 470 may include an axis 99. Axis 99 may be coaxial to center axis 95. Body 473 may revolve about axis 99. Aft clamp ring 470 may also include fastening holes 493 configured to fasten the aft clamp ring 470 to other components of the turbine 400.

Figure 4:
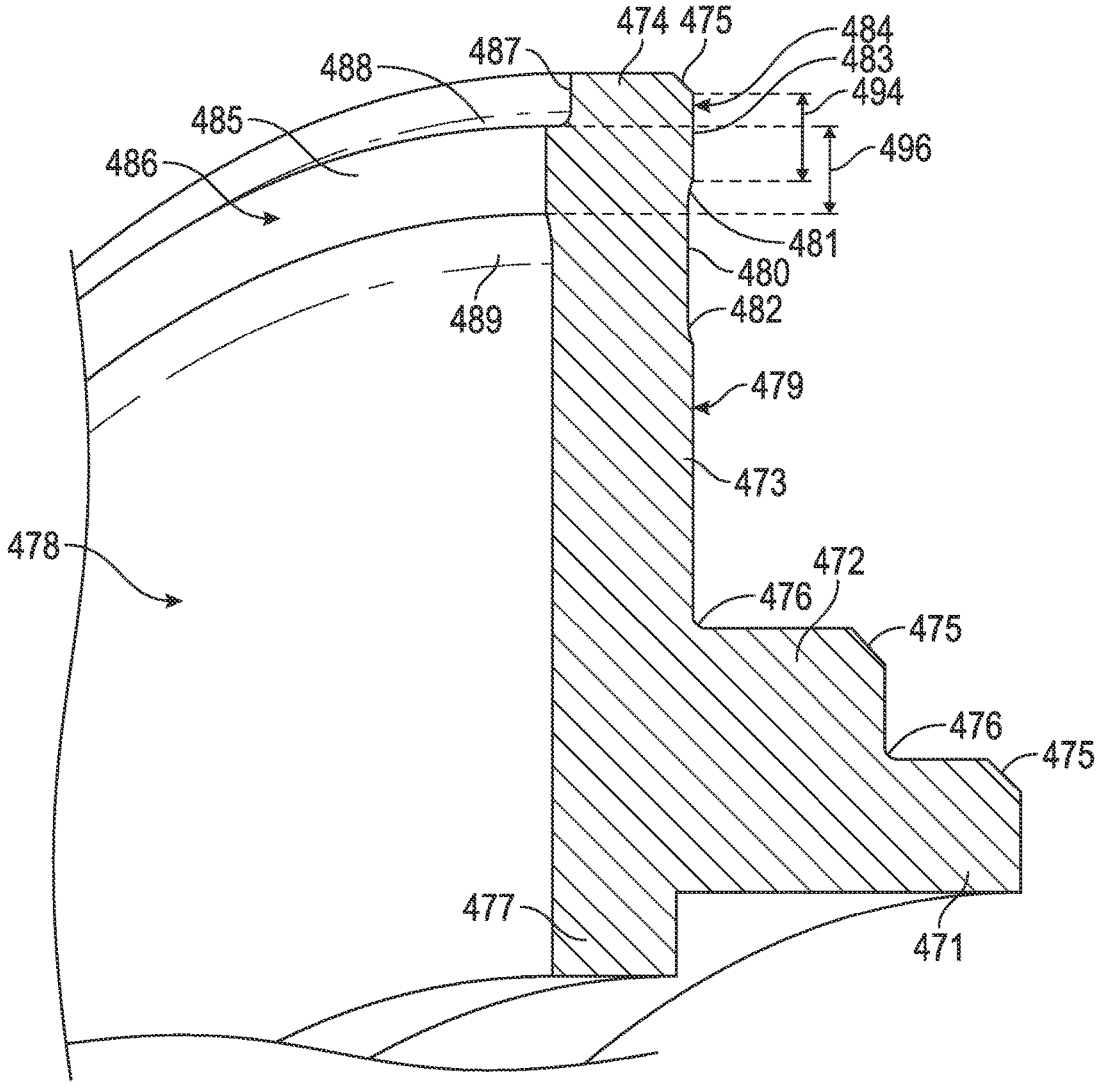
FIG. 4 is a section view of a portion of the aft clamp ring of FIG. 3.
Figure 5:
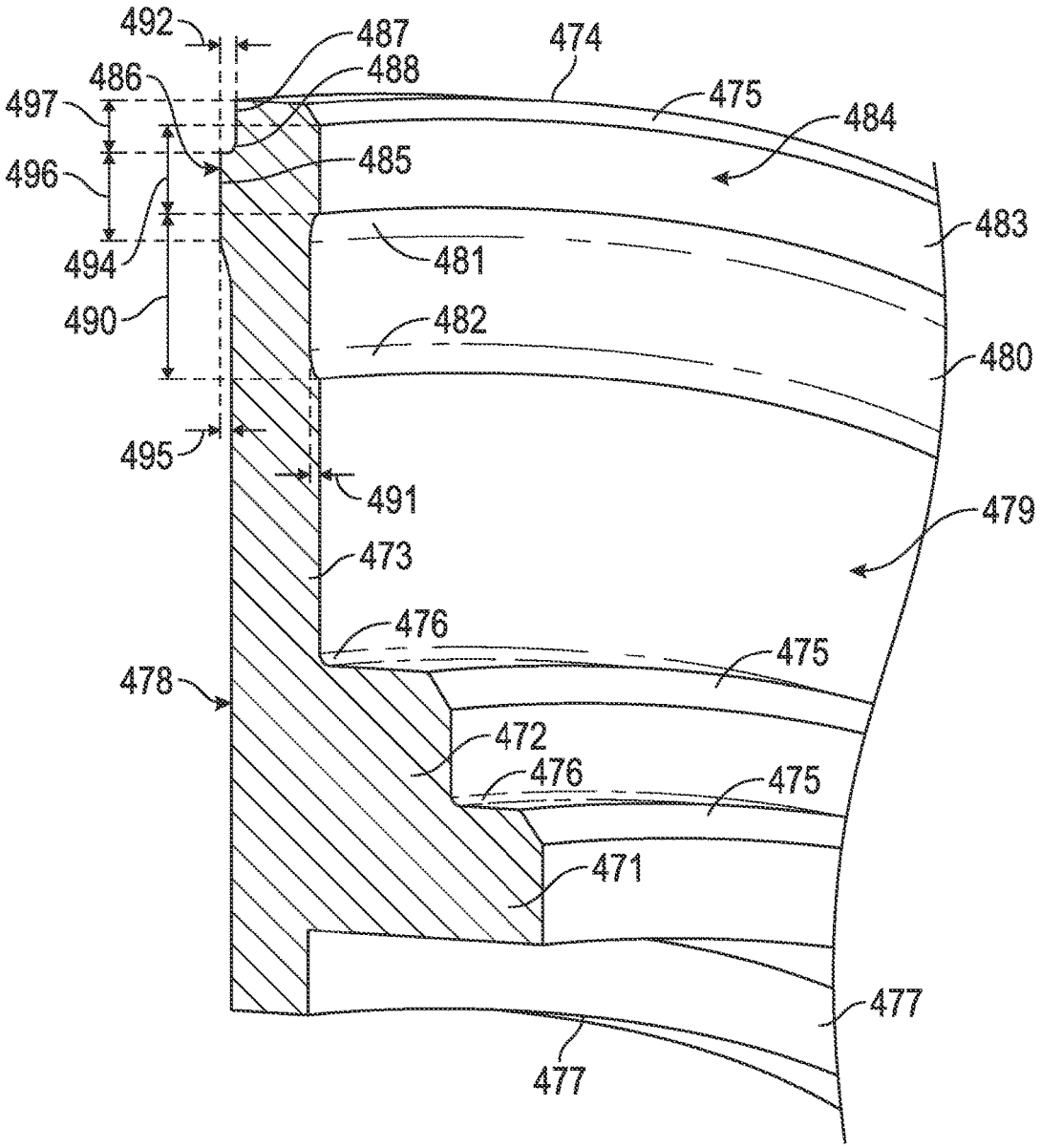
FIG. 5 is an alternate section view of the portion of the aft clamp ring of FIG. 4.

FIG. 4 is a section view of a portion of the aft clamp ring 470 of FIG. 3. FIG. 5 is an alternate section view of the portion of the aft clamp ring 470 of FIG. 4. Referring to FIGS. 4 and 5, forward sealing face 486 includes a forward sealing face height 496 and aft sealing face 484 includes an aft sealing face height 494. In some embodiments, forward sealing face height 496 and aft sealing face height 494 are equal. In other embodiments, forward sealing face height 496 and aft sealing face height 494 are configured so that the surface areas of forward sealing face 486 and aft sealing face 484 are equal. In some embodiments, forward sealing face height 496 is from 4.191 mm (0.165 in.) to 4.445 mm (0.175 in.), and aft sealing face height 494 is from 4.318 mm (0.170 in.) to 4.902 mm (0.193 in.). In some embodiments, the surface area of forward sealing face 486 is from 105.50 $cm^2$ (16.353 $in.^2$) to 165.19 $cm^2$ (25.605 $in.^2$), and the surface area of aft sealing face 484 is from 105.50 $cm^2$ (16.353 $in.^2$) to 165.19 $cm^2$ (25.605 $in.^2$). In other embodiments, the surface area of forward sealing face 486 is from 133.5 $cm^2$ (20.7 $in.^2$) to 142.6 $cm^2$ (22.1 $in.^2$), and the surface area of aft sealing face 484 is from 140.57 $cm^2$ (21.789 $in.^2$) to 155.28 $cm^2$ (24.068 $in.^2$).

Forward sealing portion 485 may include a forward sealing portion width 495 and forward cutback 487 may include a forward cutback depth 492. Forward cutback depth 492 may be greater than forward sealing portion width 495. Forward cutback 487 may also include a forward cutback height 497. Forward cutback height 497 may be the distance from forward sealing portion 485 to outer end 474. Aft cutback 480 may include an aft cutback height 490 and an aft cutback depth 491. Aft cutback height 490 may be greater than aft sealing face height 494.

Forward cutback 487 may include a cutback fillet 488. Cutback fillet 488 may include a radius that is less than the forward cutback depth 492. Forward sealing portion 485 may also include forward fillet 489. Forward fillet 489 may form the transition from forward sealing portion 485 to body 473. The radius of forward fillet 489 may be greater than forward sealing portion width 495.

Aft cutback 480 may include an outer round 481 adjoining aft sealing face 484 and an inner round 482 adjoining aft surface 479. The radii for outer round 481 and inner round 482 may be equal. In some embodiments, the radii for outer round 481 and inner round 482 are greater than aft cutback depth 491. In other embodiments, the radii for outer round 481 and inner round 482 are greater than two times the aft cutback depth 491. Other corners of aft clamp ring 470 may also include a round 476 and various edges of aft clamp ring 470 may include a chamfer 475, such as the adjoining corner of outer end 474 and aft sealing portion 483.

One or more of the above components (or their subcomponents) may be made from stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, INCONEL, WASPALOY, RENE alloys, HAYNES alloys, INCOLOY, MP98T, TMS alloys, and CMSX single crystal alloys.

INDUSTRIAL APPLICABILITY

Gas turbine engines may be suited for any number of industrial applications such as various aspects of the oil and gas industry (including transmission, gathering, storage, withdrawal, and lifting of oil and natural gas), the power generation industry, cogeneration, aerospace, and other transportation industries.

Referring to FIG. 1, a gas (typically air 10) enters the inlet 110 as a "working fluid", and is compressed by the compressor 200. In the compressor 200, the working fluid is compressed in an annular flow path 115 by the series of compressor disk assemblies 220. In particular, the air 10 is compressed in numbered "stages", the stages being associated with each compressor disk assembly 220. For example, "4th stage air" may be associated with the 4th compressor disk assembly 220 in the downstream or "aft" direction, going from the inlet 110 towards the exhaust 500). Likewise, each turbine disk assembly 420 may be associated with a numbered stage.

Once compressed air 10 leaves the compressor 200, it enters the combustor 300, where it is diffused and fuel is added. Air 10 and fuel are injected into the combustion chamber 390 via injector 310 and combusted. Energy is extracted from the combustion reaction via the turbine 400 by each stage of the series of turbine disk assemblies 420. Exhaust gas 90 may then be diffused in exhaust diffuser 510, collected and redirected. Exhaust gas 90 exits the system via an exhaust collector 520 and may be further processed (e.g., to reduce harmful emissions, and/or to recover heat from the exhaust gas 90).

Gas turbine engines 100 generally operate under high pressures. Over time, reduced sealing pressure for flanges may be reduced by flange coining and bolt load relaxation. Reduced sealing pressure in a flange may lead to leakage of air at compressor discharge pressure, such as cooling air, out of the gas turbine engine 100 through a flange or into other portions of the gas turbine engine 100. Such leakage may reduce operating efficiency of the gas turbine engine 100 and may lead to shut down of the gas turbine engine 100 until the seal is restored.

Providing an aft clamp ring 470 with a forward sealing portion 485 and an aft sealing portion 483 may prevent or reduce the load distribution of the bolt load beyond the forward sealing face 486 on a forward side of aft clamp ring 470 and beyond the aft sealing face 484 on an aft side of aft clamp ring 470. With the bolt load focused on forward sealing face 486 and aft sealing face 484, forward sealing face 486 may be configured to contact case flange 463 and aft sealing face 484 may contact exhaust diffuser 510 at a pressure from 1828 kg/cm$^2$ (26,000 psi) to 2110 kg/cm$^2$ (30,000 psi) on each surface, which may be sufficient to maintain a seal with an adjoining surface even if flange coining and bolt load relaxation were to occur.

Providing forward sealing face 486 on a protrusion may reduce or prevent load distribution to forward surface 478 from forward sealing face 486, and providing aft cutback 480 between aft sealing face 484 and aft surface 479 may reduce or prevent load distribution to aft surface 479 from aft sealing face 484.

The preceding detailed description is merely exemplary in nature and is not intended to limit the invention or the application and uses of the invention. The described embodiments are not limited to use in conjunction with a particular type of gas turbine engine. Hence, although the present disclosure, for convenience of explanation, depicts and describes particular a particular power turbine flange assembly, it will be appreciated that the aft clamp ring in accordance with this disclosure can be implemented in various other configurations, can be used with various other types of flange assemblies, and can be used in other types of machines. Furthermore, there is no intention to be bound by any theory presented in the preceding background or detailed description. It is also understood that the illustrations may include exaggerated dimensions to better illustrate the referenced items shown, and are not consider limiting unless expressly stated as such.

What is claimed is:

1. An aft clamp ring for a gas turbine engine, the aft clamp ring comprising:

a body with an annular shape revolved about an axis, the body including an outer end, an inner end located radially inward and distal to the outer end, an aft surface facing in a first axial direction, and a forward surface facing in a second axial direction opposite the first axial direction;

a first protrusion proximate the inner end extending from the body in the first axial direction;

a second protrusion extending from the first protrusion in the first axial direction, the second protrusion being radially narrower than the first protrusion;

a forward sealing portion extending in the second axial direction from the body, the forward sealing portion including a forward sealing face proximate the outer end facing in the second axial direction and located radially outward and axially forward of the forward surface, the forward sealing face being a first annular surface;

an aft sealing portion including an aft sealing face adjacent the outer end facing in the first axial direction and located radially outward of the aft surface, the aft sealing face being a second annular surface; and an aft cutback separating the aft sealing face from the aft surface.

2. The aft clamp ring of claim 1, wherein the forward sealing face includes a forward sealing face height from 4.191 mm to 4.445 mm, and the aft sealing face includes an aft sealing face height from 4.318 mm to 4.902 mm.

3. The aft clamp ring of claim 1, wherein the forward sealing face includes a first surface area from 133.5 cm$^2$ to 142.6 cm$^2$ and the aft sealing face includes a second surface area from 140.57 cm$^2$ to 155.28 cm$^2$.

4. The aft clamp ring of claim 1, wherein the aft cutback includes an outer round adjoin the aft sealing face and an inner round adjoining the aft surface, and wherein the radii of the outer round and the inner round are greater than two times the aft cutback depth.

5. The aft clamp ring of claim 1, wherein further comprising a forward cutback extending from the forward sealing portion to the outer end.

6. The aft clamp ring of claim 1, wherein the aft sealing face is coplanar to the aft surface.

7. A gas turbine engine including the aft clamp ring of claim 1, the gas turbine engine further comprising:

a turbine housing;

an exhaust diffuser clamped to the turbine housing; and a nozzle case including a case flange;

wherein the case flange and the body are clamped between the turbine housing and the exhaust diffuser with the forward sealing face contacting the case flange at a first pressure from 1828 kg/cm$^2$ to 2110 kg/cm$^2$ and the aft sealing face contacting the exhaust diffuser at a second pressure from 1828 kg/cm$^2$ to 2110 kg/cm$^2$.

8. An aft clamp ring for a gas turbine engine, the aft clamp ring comprising:

a body with an annular shape revolved about an axis, the body including an outer end, an inner end located radially inward and distal to the outer end, an aft surface facing in a first axial direction, and a forward surface facing in a second axial direction opposite the first axial direction;

a first protrusion proximate the inner end extending from the body in the first axial direction;

a second protrusion extending from the first protrusion in the first axial direction, the second protrusion being radially narrower than the first protrusion;

a forward sealing portion extending in the second axial direction from the body, the forward sealing portion including a forward sealing face spaced apart from the outer end facing in the second axial direction and located radially outward and axially forward of the forward surface, the forward sealing face being a first annular surface;

an aft sealing portion including an aft sealing face adjacent the outer end facing in the first axial direction, located radially outward of the aft surface, and at least partially radially aligned with the forward sealing face, the aft sealing face being a second annular surface; and an aft cutback separating the aft sealing face from the aft surface and extending into the body at an aft cutback depth, the aft cutback including an outer round adjoining the aft sealing face and an inner round adjoining the aft surface where, the radii of the outer round and the inner round being greater than the aft cutback depth.

9. The aft clamp ring of claim 8, wherein the forward sealing face includes a first surface area from 133.5 $cm^2$ to 142.6 $cm^2$ and the aft sealing face includes a second surface area are from 140.57 $cm^2$ to 155.28 $cm^2$.

10. The aft clamp ring of claim 8, further comprising a forward cutback extending from the forward sealing portion to the outer end.

11. The aft clamp ring of claim 10, wherein the aft sealing face is coplanar to the aft surface.

12. A power turbine flange assembly of the gas turbine engine including the aft clamp ring of claim 8, the power turbine flange assembly further comprising:

a turbine housing;

an exhaust diffuser clamped to the turbine housing; and a nozzle case including a case flange;

wherein the aft clamp ring is clamped between the case flange and the exhaust diffuser with the forward sealing face contacting the case flange at a first pressure from 1828 $kg/cm^2$ to 2110 $kg/cm^2$ and the aft sealing face contacting the exhaust diffuser at a second pressure from 1828 $kg/cm^2$ to 2110 $kg/cm^2$.

13. An aft clamp ring for a gas turbine engine, the aft clamp ring comprising:

a body with an annular shape extending between an outer end and an inner end located radially inward from the outer end, the body including an aft surface facing in a first axial direction, and a forward surface facing in a second axial direction opposite the first axial direction;

a forward sealing portion extending in the second axial direction from the body, the forward sealing portion including a forward sealing face facing in the second axial direction, the forward sealing face being a first annular surface with a first surface area from 105.50 $cm^2$ to 165.19 $cm^2$;

an aft sealing portion including an aft sealing face adjacent the outer end facing in the first axial direction and at least partially radially aligned with the forward sealing face, the aft sealing face being a second annular surface with a second surface area from 105.50 $cm^2$ to 165.19 $cm^2$; and an aft cutback separating the aft sealing face from the aft surface.

14. The aft clamp ring of claim 13, wherein the first surface area is from 133.5 $cm^2$ to 142.6 $cm^2$ and the second surface area is from 140.57 $cm^2$ to 155.28 $cm^2$.

15. The aft clamp ring of claim 13, wherein the aft cutback extends into the body at an aft cutback depth, wherein the aft cutback includes an outer round adjoining the aft sealing face and an inner round adjoining the aft surface, and wherein the radii of the outer round and the inner round are greater than the aft cutback depth.

16. The aft clamp ring of claim 13, further comprising a forward cutback extending from the forward sealing portion to the outer end.

17. The aft clamp ring of claim 13, wherein the forward sealing face includes a forward sealing face height from 4.191 mm to 4.445 mm, and the aft sealing face includes an aft sealing face height from 4.318 mm to 4.902 mm.

18. A power turbine flange assembly for the gas turbine engine including the aft clamp ring of claim 13, the power turbine flange assembly further comprising:

a turbine housing including an aft portion, an aft flange extending radially outward from the aft portion, a secondary aft flange extending from the aft flange in the first axial direction, and a case contacting portion adjoining and located radially inward from the secondary aft flange;

an exhaust diffuser including a diffuser body, a diffuser flange extending radially outward from the diffuser body, and a secondary diffuser flange extending from the diffuser flange in the second axial direction opposite the first axial direction, the secondary diffuser flange adjoining the secondary aft flange;

a nozzle case including a case body, and a case flange extending radially outward from the case body, the case flange including forward surface facing in the second axial direction and configured to contact the case contacting portion; and a plurality of bolts configured to clamp the case flange and the body between the turbine housing and the exhaust diffuser.

* * * * *